US012180879B2

(12) United States Patent
Sullins

(10) Patent No.: US 12,180,879 B2
(45) Date of Patent: Dec. 31, 2024

(54) APPARATUS AND METHOD FOR FAN SOFT-START CONTROLLER

(71) Applicant: Integrity Circuits LLC, Beaverton, OR (US)

(72) Inventor: Jason L. Sullins, Beaverton, OR (US)

(73) Assignee: Integrity Circuits LLC, Beaverton, OR (US)

( * ) Notice: Subject to any disclaimer, the term of this patent is extended or adjusted under 35 U.S.C. 154(b) by 0 days.

(21) Appl. No.: 18/229,549

(22) Filed: Aug. 2, 2023

(65) Prior Publication Data

US 2023/0374930 A1 Nov. 23, 2023

Related U.S. Application Data

(63) Continuation of application No. 17/587,996, filed on Jan. 28, 2022, now abandoned, which is a continuation of application No. 17/459,013, filed on Aug. 27, 2021, now abandoned.

(51) Int. Cl.
*F01P 7/04* (2006.01)

(52) U.S. Cl.
CPC ..... *F01P 7/048* (2013.01); *F01P 2025/46* (2013.01); *F01P 2037/02* (2013.01)

(58) Field of Classification Search
CPC .... F01P 7/048; F01P 2025/46; F01P 2037/02; H02P 1/163; H02P 1/265; H02P 6/08; H02P 6/20; H02P 6/21; H02P 7/29; F04D 27/004; B60L 1/003
See application file for complete search history.

(56) References Cited

U.S. PATENT DOCUMENTS 4,230,075 A * 10/1980 Lowther ..... F02B 41/00 123/39
4,628,235 A 12/1986 Goings
(Continued)

FOREIGN PATENT DOCUMENTS

CN 201220683001 5/2013
JP 201121993 A 3/1995
(Continued)

OTHER PUBLICATIONS

Author: unknown; Title: Digital Variable Speed Fan Controller; Item: Website: https://www.proformparts.com/product-detail/69595/digital-variable-speed-electric-fan-s-controller-push-in-and-thread-in-probes; Date Accessed: Sep. 8, 2021; Published: US.

*Primary Examiner* — John M Zaleskas
(74) *Attorney, Agent, or Firm* — Bamert Regan PLLC

(57) ABSTRACT

A system and method for controlling the operation of a vehicle radiator fan motor is provided. One embodiment receives one of a low-speed radiator fan control signal or a high-speed radiator fan control signal from an engine control module; provides a first soft start of the radiator fan motor in response to receiving the low-speed radiator fan control signal, wherein the first soft start is defined by a first increasing power ramp that starts at a zero-power level and ends at a low-speed power level; and provides a second soft start of the radiator fan motor in response to receiving the high-speed radiator fan control signal, wherein the second soft start is defined by a second increasing power ramp that starts at the zero-power level and ends at a high-speed power level.

19 Claims, 2 Drawing Sheets

(56) References Cited

U.S. PATENT DOCUMENTS

| | | | | |
|---|---|---|---|---|
| 4,651,922 | A * | 3/1987 | Noba | F04D 25/166 236/35 |
| 5,557,182 | A | 9/1996 | Hollenbeck | |
| 8,907,607 | B1 | 12/2014 | Ma | |
| 10,103,676 | B2 | 10/2018 | Tseng | |
| 2001/0039926 | A1 | 11/2001 | Kobayashi | |
| 2002/0030463 | A1 | 3/2002 | Sunaga | |
| 2004/0066156 | A1 | 4/2004 | Makaran | |
| 2004/0232864 | A1 | 11/2004 | Sunaga | |
| 2004/0247449 | A1 | 12/2004 | Ma | |
| 2005/0077846 | A1 | 4/2005 | Makaran | |
| 2005/0231146 | A1 | 10/2005 | De Frutos | |
| 2005/0254959 | A1 | 11/2005 | Furuta | |
| 2006/0181232 | A1 | 8/2006 | Oljaca | |
| 2006/0267525 | A1 | 11/2006 | Tembreull | |
| 2007/0033966 | A1 | 2/2007 | Eisenhour | |
| 2007/0101747 | A1 | 5/2007 | Eisenhour | |
| 2008/0048598 | A1 | 2/2008 | Shibuya | |
| 2009/0066280 | A1 | 3/2009 | Hayashi | |
| 2009/0119056 | A1* | 5/2009 | Lehner | G01K 7/42 702/136 |
| 2009/0128065 | A1 | 5/2009 | Hsu et al. | |
| 2009/0153084 | A1 | 6/2009 | Mishima | |
| 2009/0309535 | A1 | 12/2009 | Kitagawa | |
| 2010/0256892 | A1* | 10/2010 | Shartzer | F02D 41/062 701/104 |
| 2011/0016957 | A1* | 1/2011 | Haladyna | F01M 13/04 73/114.31 |
| 2011/0139412 | A1 | 6/2011 | Mishima | |
| 2012/0194115 | A1 | 8/2012 | Hu | |
| 2012/0217907 | A1 | 8/2012 | Sakaguchi | |
| 2012/0274252 | A1 | 11/2012 | He | |
| 2012/0306416 | A1 | 12/2012 | Hano | |
| 2013/0009578 | A1 | 1/2013 | Reynolds | |
| 2014/0000536 | A1* | 1/2014 | Glassford | F01P 7/14 236/34.5 |
| 2015/0369157 | A1* | 12/2015 | Lehmen | F02D 41/064 701/105 |
| 2016/0001624 | A1 | 1/2016 | Meissner | |
| 2017/0198654 | A1* | 7/2017 | Yu | F02D 41/0007 |
| 2020/0295681 | A1 | 9/2020 | Thomas et al. | |
| 2023/0067487 | A1* | 3/2023 | Sullins | F01P 7/048 |

FOREIGN PATENT DOCUMENTS

| | | | |
|---|---|---|---|
| JP | 2000116178 | | 4/2000 |
| JP | 2004044507 | A * | 2/2004 |
| JP | 2008280973 | A * | 11/2008 |
| KR | 20020093393 | A * | 12/2002 |

* cited by examiner

APPARATUS AND METHOD FOR FAN SOFT-START CONTROLLER

PRIORITY CLAIM

This application is a Continuation of, and claims priority, to copending U.S. application Ser. No. 17/587,996, filed on Jan. 28, 2022, entitled Apparatus and Method For Fan Soft-Start Controller, which claims priority to U.S. application Ser. No. 17/459,013, filed on Aug. 27, 2021, entitled Apparatus and Method For Fan Soft-Start Controller, both of which are hereby incorporated by reference in their entirety for all purposes.

BACKGROUND OF THE INVENTION

Vehicle radiator fans are used in vehicles to transport cool ambient air over the vehicle's radiator so that the cooled radiator fluid may be transported into the vehicle's combustion engine to cool the engine. Based on an engine temperature signal, the vehicle's engine control module generates a control signal that is communicated to a fan speed controller that actuates the motor of the vehicle radiator fan. Typically, the motor of the vehicle radiator fan operates at either full speed or reduced low speed based on the current engine temperature.

When the fan speed controller actuates the motor of a vehicle radiator fan, the vehicle's electrical system provides power to the vehicle radiator fan. However, the inrush current required to start the motor of the vehicle radiator fan causes a brief voltage drop in the vehicle's electrical system. More significantly, the current surge drawn by the radiator fan results in a proportional increase in current draw from the alternator. This in turn translates into the alternator exerting a higher mechanical load on the engine causing the engine speed (revolution per minute, or RPM) to drop abruptly. In some vehicles, the abrupt increase in loading from the alternator and the attendant RPM drop may cause the vehicle engine to stall. This voltage drop may have an adverse effect on other electronic devices in the vehicle that are voltage sensitive. Further, the mechanical forces imposed on the motor of the vehicle radiator fan during the startup of the motor may have an adverse impact on the radiator fan motor. For example, the wear and tear on the radiator fan motor may shorten the useful life of the radiator fan motor.

Conversely, when the fan speed controller shuts off the vehicle radiator fan, there may be an undesirable brief voltage rise in the vehicle's electrical system. Here, when the vehicle radiator fan shuts off, mechanical load of the alternator abruptly decreases resulting in an abrupt increase in the vehicle engine speed. More significantly, the repeated cycling of the vehicle's radiator fan between the on and off states will eventually adversely affect the life of the radiator fan motor, and may potentially adversely affect some electronic components in the vehicle.

Accordingly, in the arts of vehicle radiator fan control, there is a need in the arts for improved methods, apparatus, and systems for controlling the operation of a vehicle's radiator fan.

SUMMARY OF THE INVENTION

Embodiments of the radiator fan soft-start controller provide a system and method for controlling operation of a vehicle radiator fan motor. One embodiment receives one of a low-speed radiator fan control signal or a high-speed radiator fan control signal from an engine control module; provides a first soft start of the radiator fan motor in response to receiving the low-speed radiator fan control signal, wherein the first soft start is defined by a first increasing power ramp that starts at a zero-power level and ends at a low-speed power level; and provides a second soft start of the radiator fan motor in response to receiving the high-speed radiator fan control signal, wherein the second soft start is defined by a second increasing power ramp that starts at the zero-power level and ends at a high-speed power level.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
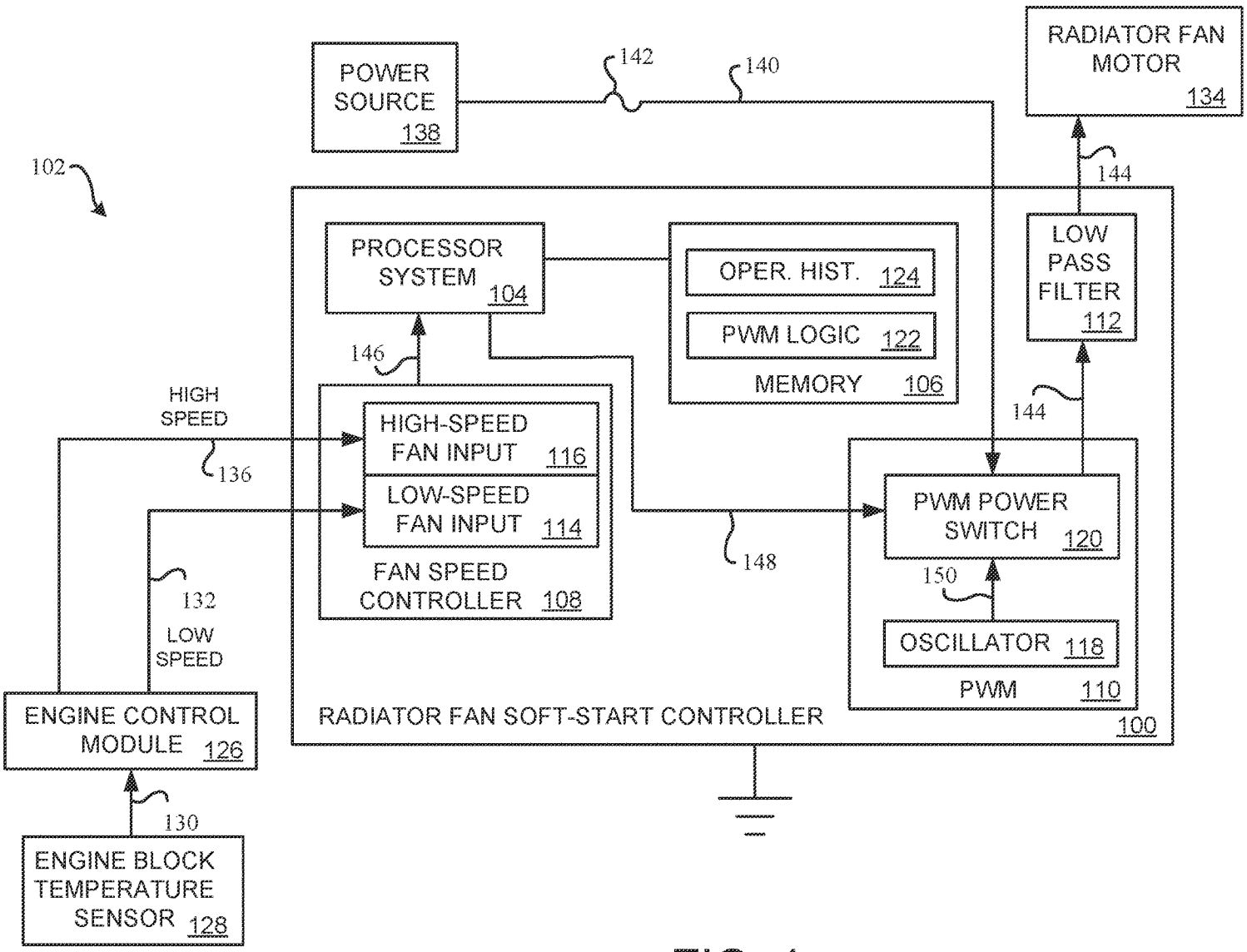
FIG. 1 is a block diagram of a radiator fan soft-start controller implemented in a legacy vehicle electric system.

FIG. 1 is a block diagram of a radiator fan soft-start controller 100 implemented in a legacy vehicle electric system 102. A non-limiting example embodiment of the radiator fan soft-start controller 100 comprises a processor system 104, a memory 106, a fan speed controller 108, a pulse width modulator (PWM) 110, and an optional low pass filter 112. The fan speed controller 108 comprises a low-speed fan input 114 and a high-speed fan input 116. The PWM 110 comprises an oscillator 118 and a PWM power switch 120. The memory 106 comprises portions for storing the pulse width modulation (PWM) logic 122 and an optional operating history 124. In some embodiments, the PWM logic 122 may be integrated with other logic. In other embodiments, some or all of these memory and other data manipulation functions may be provided by using a remote server or other electronic devices suitably connected via the Internet or otherwise to a client device. Other embodiments of the radiator fan soft-start controller 100 may include some, or may omit some, of the above-described components. Further, additional components not described herein may be included in alternative embodiments. In some embodiments, the functionality of the radiator fan soft-start controller 100 may be implemented in firmware, hardware, or a combination of firmware and hardware. For example, but not limited to, an analog embodiment may be configured to provide a low-speed startup and/or high-speed startup of the radiator fan as described herein.

Embodiments of the radiator fan soft-start controller 100 provide pulse width modulated (PWM) power to the vehicle's radiator fan motor (interchangeably referred to herein as the radiator fan). Using PWM technology, the fan is initially provided a low power amount that gradually starts the fan motor. As time progresses, during a startup period, the power provided to the fan motor gradually increases and reaches a desired level that operates the fan motor at an intended speed. Accordingly, problems arising from the abrupt power input to the fan motor, and the associated current inrush and voltage drop, provided by legacy vehicle electric systems 102 are avoided.

Some embodiments may be configured to end fan motor operation using PWM technology. The fan is initially fully powered so as to operate at an intended speed. When the vehicle electric system 102 turns the fan off, the radiator fan soft-start controller 100 begins to gradually reduce the amount of power provided to the fan motor. As time progresses, during a soft shutdown period, the power provided to the fan motor gradually decreases and reaches a zero-power level that reduces the fan motor to zero revolutions per minute (RPM). Accordingly, problems arising from the abrupt power loss to the fan motor provided by legacy vehicle electric systems 102 is avoided.

The disclosed systems and methods for a radiator fan soft-start controller 100 will become better understood through review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations. However, for the sake of brevity, each and every contemplated variation is not individually described in the following detailed description.

Throughout the following detailed description, various examples for systems and methods for a radiator fan soft-start controller 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components. "Secured to" means directly connected without intervening components.

"Communicatively coupled" means that an electronic device exchanges information with another electronic device, either wirelessly or with a wire-based connector, whether directly or indirectly through a communication network 108. "Controllably coupled" means that an electronic device controls operation of another electronic device.

Returning to FIG. 1, a preferred embodiment of the radiator fan soft-start controller 100 is configured to be installed in a legacy vehicle electric system. However, embodiments may be provided by the original equipment manufacturer (OEM) during manufacture of the vehicle.

The fan speed controller 108 is configured to receive fan turn on and turn off signals from the vehicle's engine control module 126. When the engine block temperature sensor 128 detects engine block temperature exceeding one or more predefined threshold temperatures, the sensor 128 communicates a signal via connection 130 to the engine control module 126. In other vehicle electric systems 102, the sensor 128 communicates temperature information to the engine control module 126. Here, the engine control module 126 compares the sensed engine block temperature with the one or more predefined threshold temperatures.

In an example embodiment, the engine control module 126 in the vehicle's electric system 102 is configured to output one of a low fan speed control signal on connection 132 to operate the radiator fan motor 134 at a low speed, or a high fan speed control signal on connection 136 to operate the radiator fan motor 134 at a higher speed, based on the sensed temperature of the engine block. Preferably, the radiator fan motor 134 is a variable speed, direct current (DC) motor. However, any suitable radiator fan motor 134 may be controlled by embodiments of the radiator fan soft-start controller 100.

For example, but not limited to, the vehicle electric system 102 may be configured to operate the radiator fan motor 134 at its full speed (highest speed in RPM) and a lower speed, such as half speed (lower speed in RPM). Other vehicles may be configured to operate the radiator fan motor 134 at more than two speeds, or may be configured to operate the radiator fan motor 134 at a single speed. Some types of engine control modules 126 may output different control signals via a single connector (where fan speed is specified by a specific voltage or in a digital signal). Embodiments of the radiator fan soft-start controller 100 can be configured to receive any suitable fan speed signal from a vehicle's engine control module 126. Other embodiments may be configured to receive a temperature signal directly from the engine block temperature sensor 128.

Some embodiments of the radiator fan soft-start controller 100 and/or the engine control module 126 may be configured to adjust or determine fan speed based on ambient temperature. For example, the radiator fan motor 134 may be operated at a lower speed on a cold winter night, as contrasted with the need for a higher speed on a hot summer day.

The example vehicle electric system 102 described herein with a low fan speed and a high fan speed is intended to conceptually disclose embodiments of the radiator fan soft-start controller 100. One skilled in the art appreciates that there are many ways in which the radiator fan motor 134 can be actuated based on the sensed engine block temperature. Any vehicle electric systems 102 that control the radiator fan motor 134 now known or later developed are intended to be within the scope of this disclosure and to be protected by the accompanying claims.

Typically, the vehicle electric system 102 provides electrical power to the various vehicle components for a power source 138. The power source 138 may be one or more batteries, a generator, an alternator, or a combination thereof. The purpose of the radiator fan soft-start controller 100 is to control the power provided to the radiator fan motor 134 from the power source 138. Accordingly, the radiator fan soft-start controller 100 is coupled to the power source 138 via connection 140, and optionally via a fuse 142 power source 138. The regulated power is provided from the radiator fan soft-start controller 100 to the radiator fan motor 134 via connection 144. (In some embodiments, the optional fuse 142 and/or a secondary fuse may be included on connection 144.)

In the preferred embodiment, the low-speed fan input 114 of the fan speed controller 108 is configured to communicatively couple to the low-speed output connector 132 that is coupled to a legacy engine control module 126. The high-speed fan input 116 of the fan speed controller 108 is configured to communicatively couple to the high-speed output connector 136 that is coupled to the legacy engine control module 126. Here, the radiator fan soft-start controller 100 can be incorporated into a legacy vehicle electric system 102. The fan speed controller 108 provides a suitable control signal, via connection 146, to the processor system 104 that indicates the intended operational speed of the radiator fan motor 134. Here, the control signal on connection 146 may be an analog signal or a digital signal.

Based on the intended operational speed of the radiator fan motor 134, the processor system 104 outputs a control signal to the PWM power switch 120 residing in the PWM 110. Preferably, the PWM power switch 120 is a solid-state electric power switch that passes power from the power source 138 to the radiator fan motor 134, via connection 144, when actuated (gated) to an on state (conducting state). That is, a power pulse is initially generated by turning PWM power switch 120 to an on state to begin each one of the series of power pulses. The PWM power switch 120 blocks power when in an off state (non-conducting state). Here, the power pulse is ended by turning the PWM power switch 120 to the off state to end each one of the series of power pulses.

The control signal communicated from the processor system 104, via connection 148, controls the PWM power switch 120 between the on state and the off state. The optional oscillator 118, via connection 150, may be included to facilitate the transition from the on state to the off state of the PWM power switch 120.

In some embodiments, the PWM power switch 120 passes the power to the radiator fan motor 134 via an optional low pass filter 112. The low pass filter 112 is configured to smooth out and average, or otherwise condition, the transitioning power signal. Any suitable low pass filter 112 (or high pass filter) may be used in the various embodiments.

When the radiator fan soft-start controller 100 employs an analog signal-based system, an analog circuit creates the pulse magnitude control ramp signals. An analog embodiment may use fewer components that the example digital signal-based system illustrated in FIG. 1.

When the radiator fan soft-start controller 100 employs a digital signal-based system, the processor system 104 retrieves and executes the PWM logic 122. The PWM logic 122 provides instructions to enable the processor system 104 to regulate power to the radiator fan motor 134 by control of the PWM 110. The PWM logic 122 may optionally include instructions that enable the processor system 104 to track and record various operating conditions that may be saved into the operating history 124. The information stored in the operating history 124 may be used for diagnostic purposes or the like.

Figure 2:
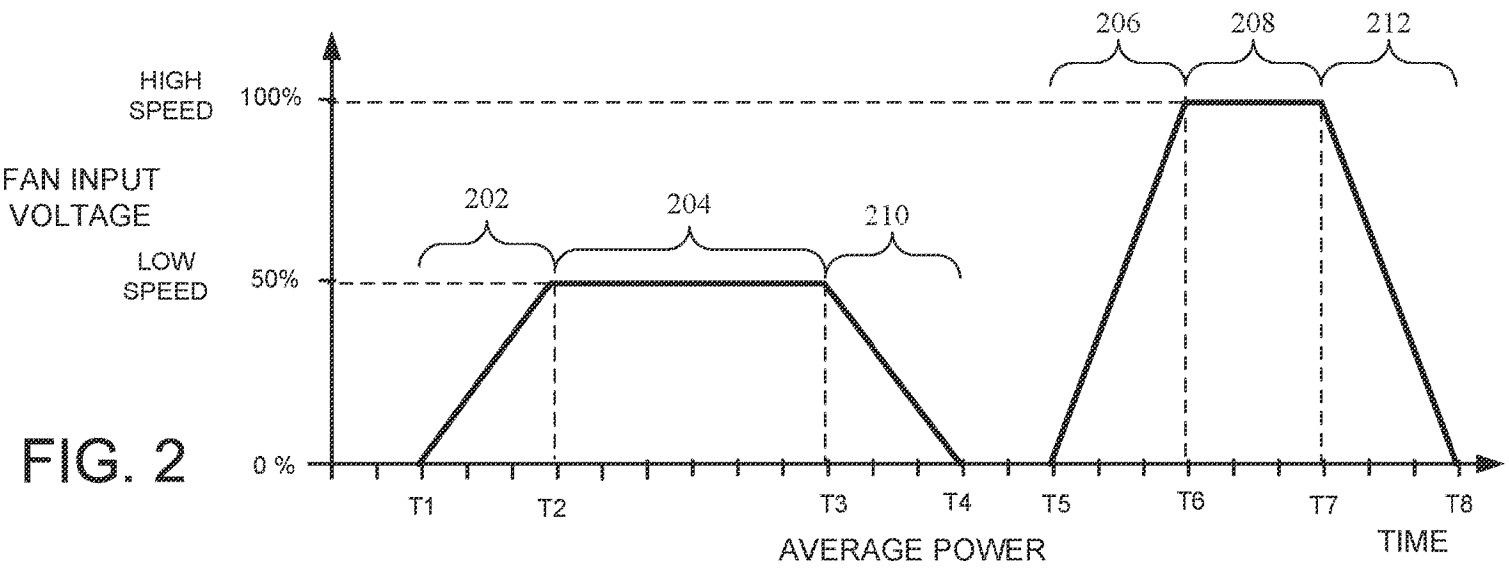
FIG. 2 is a plot of the average power voltage provided to the radiator fan motor by embodiments of the radiator fan soft-start controller.
Figure 3:
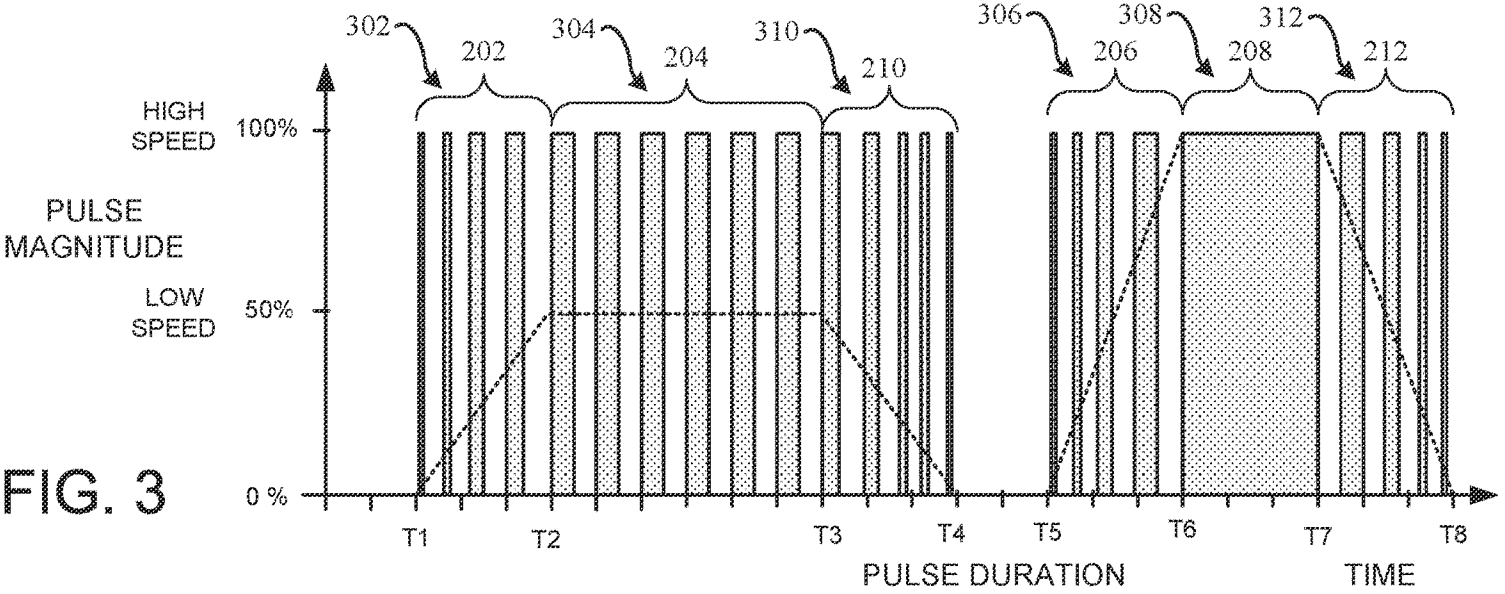
FIG. 3 is a plot of the PWM power pulses provided to the radiator fan motor by embodiments of the radiator fan soft-start controller.

FIG. 2 is a hypothetical conceptual plot of the average power voltage provided to the radiator fan motor 134 by embodiments of the radiator fan soft-start controller 10. FIG. 3 is a hypothetical conceptual plot of the PWM power pulses provided to the low pass filter 112 which then provides conditioned power to the radiator fan motor 134 by embodiments of the radiator fan soft-start controller 100.

As noted herein, embodiments of the radiator fan soft-start controller 100 provide pulse width modulated (PWM) power to the vehicle's radiator fan motor 134. During a low-speed soft-start period 202, using PWM technology, the radiator fan motor 134 is initially provided a low power amount at time T1 that gradually starts the radiator fan motor 134. As time progresses, during the low-speed startup period 202 that ranges from T1 to T2, the average power provided to the radiator fan motor 134 gradually increases the speed of the radiator fan motor 134. At the end of the low-speed startup period 202, the radiator fan motor 134 reaches the intended speed since a desired average power level is provided that operates the fan motor at the intended low speed, beginning at time T2. That is, the low-speed startup period 202 is defined as an increasing power ramp that starts at a zero-power level and ends at a low-speed power level.

FIG. 3 conceptually illustrates a series of increasing duration power pulses 302 provided to the filter 112, which in turn then provides conditioned power to the radiator fan motor 134 during the low-speed startup period 202. Initially, at T1, a first full voltage power pulse for a very short duration is filtered and then passed to the radiator fan motor 134 by the PWM power switch 120. As time progresses, the duration of each successive power pulse 302 increases. That is, each subsequent power pulse in the series of power pulses has an increasing duration greater than the previous power pulse.

At the end of the soft startup period 202, the average power provided to the radiator fan motor 134, via the filter 112, corresponds to the power amount needed to operate the radiator fan motor 134 at the intended low speed. For example, if the low-speed power corresponds to a half speed for the radiator fan motor 134, the duration of the full voltage power pulse 304 for a sustained half speed operation period 204, beginning at T2 and ending at T3, would be generated by a series of PWM power pulses 304 that have a duration that is the same as a duration where the PWM power switch 120 is off (wherein no power is transferred, via the filter 112, to the radiator fan motor 134), as conceptually illustrated during the period 204 in FIG. 3. During the low-speed operating period 204, between time T2 and time T3, the radiator fan motor 134 operates at its intended low speed.

During a high-speed soft-start period 206, using PWM technology, the radiator fan motor 134 is initially provided a low power amount at time T5 that gradually starts the radiator fan motor 134. As time progresses, during the high-speed startup period 206 that ranges from T5 to T6, the average power provided to the radiator fan motor 134 gradually increases and reaches a desired average power level that operates the fan motor at the intended high speed, beginning at time T6.

FIG. 3 conceptually illustrates a series of increasing duration power pulses 306 provided to the filter 112, which in turn then provides conditioned power to the radiator fan motor 134. Initially, at T5, a full voltage power pulse for a very short duration is passed, via the filter 112, to the radiator fan motor 134 by the PWM power switch 120. As time progresses, the duration of each successive power pulse increases. That is, each subsequent power pulse in the series of power pulses has an increasing duration greater than the previous power pulse.

At the end of the high-speed startup period 206, the average power provided to the radiator fan motor 134 corresponds to the power amount needed to operate the radiator fan motor 134 at the intended high speed. For example, if the high-speed power corresponds to a high speed for the radiator fan motor 134, the PWM power switch 120 remains on to provide full voltage 308 for a sustained high-speed operation period 208, beginning at T6 and ending at T7, would be generated by a series of PWM power pulses 308 that have a duration that is constantly on, as conceptually illustrated during the duration 208 in FIG. 3. During the high-speed operating period 208, between time T6 and time T7, the radiator fan motor 134 operates at its intended high speed. That is, the high-speed soft-start period 206 is defined as an increasing power ramp that starts at the zero-power level and ends at a high-speed power level.

One skilled in the art appreciates that the duration and/or frequency of power pulses during a high-speed soft start period 206 will be greater than the power pulses of the low-speed startup period 202. In some embodiments, the duration of the low-speed startup period 202 and the high-speed startup period 206 may be the same. In other embodiments, the duration of the low-speed startup period 202 is different from the duration of the high-speed startup period 206. For example, in one embodiment, the first duration of a first soft start (e.g., the high-speed startup) is less than the second duration of a second soft start (e.g., the low-speed startup). Alternatively, in another embodiment, the first duration of the first soft start (e.g., the high-speed startup) is greater than the second duration of the second soft start (e.g., the low-speed startup). The example voltage of the vehicle electric system 102 as illustrated in FIG. 3, wherein 100% corresponds to 13 volts direct current (DC). Other vehicle electric systems 102 may operate the radiator fan motor 134 at different voltages and/or using alternating current (AC).

As noted herein, some embodiments optionally perform a soft shutdown operation. Here, after the engine control module 126 communicates a control signal indicating that the radiator fan motor 134 should be shut off, the radiator fan soft-start controller 100 initiates a soft shutdown operation.

For example, when the radiator fan motor 134 is operating at a low speed, a low-speed soft shutdown period 210 begins at time T3. The low-speed soft shutdown period 210 is initiated by decreasing the duration of the next power pulse 310 that occurs at or after time T3. As time progresses, the duration of each subsequent power pulse 310 is decreased. Finally, at time T4, the low-speed soft shutdown period 210 ends, and no power is provided to the radiator fan motor 134. Here, the soft shutdown is defined by a decreasing power ramp that starts at the low-speed power level and ends at the zero-power level.

Similarly, when the radiator fan motor 134 is operating at a high speed, a high-speed soft shutdown period 212 begins at time T7. The high-speed soft shutdown period 212 is initiated by turning off the power at time T7 for some predefined duration, and then generating a power pulse of a predefined duration. Then, subsequent power pulses 312 have a decreasing duration. As time progresses, the duration of each subsequent power pulse 312 is decreased. Finally, at time T8, the high-speed soft shutdown period 212 ends, and no power is provided to the radiator fan motor 134. The soft shutdown is defined by a decreasing power ramp that starts at the low-speed power level and ends at the zero-power level.

It should be emphasized that the above-described embodiments of the radiator fan soft-start controller 100 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions, and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements, and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

Therefore, having thus described the invention, at least the following is claimed:

1. A radiator fan soft-start controller for controlling operation of a radiator fan motor of a vehicle, wherein the radiator fan soft-start controller is communicatively coupled to an engine control module that receives engine block temperature information from an engine block temperature sensor that senses an engine block temperature of a vehicle engine block, wherein the engine control module outputs a first fan speed signal via a low-speed output connector when the engine block temperature exceeds a first temperature threshold, wherein the first fan speed signal is configured to operate the radiator fan motor at a first operating speed, wherein the engine control module outputs a second fan speed signal via a high-speed output connector when the engine block temperature exceeds a second temperature threshold, wherein the second fan speed signal is configured to operate the radiator fan motor at a second operating speed, and wherein the second operating speed of the radiator fan motor is faster than the first operating speed of the radiator fan motor, the radiator fan soft-start controller comprising:

a low-speed fan input communicatively coupled to the low-speed output connector, wherein the low-speed fan input receives the first fan speed signal output by the engine control module;

a high-speed fan input communicatively coupled to the high-speed output connector, wherein the high-speed fan input receives the second fan speed signal output by the engine control module;

a pulse width modulator controllably coupled to an input of the radiator fan motor, wherein the pulse width modulator outputs a first power level that operates the radiator fan motor at the first operating speed, and wherein the pulse width modulator outputs a second power level that operates the radiator fan motor at the second operating speed; and a processor system communicatively coupled to the low-speed fan input and the high-speed fan input, and controllably coupled to the pulse width modulator, wherein the processor system controls the pulse width modulator to provide a first soft start of the radiator fan motor in response to receiving the first fan speed signal, wherein the first soft start is defined by a first increasing power ramp that starts at a zero-power level and ends at the first power level that operates the radiator fan motor at the first operating speed, and wherein the processor system controls the pulse width modulator to provide a second soft start of the radiator fan motor in response to receiving the second fan speed signal, wherein the second soft start is defined by a second increasing power ramp that starts at the zero-power level and ends at the second power level that operates the radiator fan motor at the second operating speed.

2. The radiator fan soft-start controller of claim 1, wherein the first soft start is defined by a first duration, and wherein the second soft start is defined by a second duration.

3. The radiator fan soft-start controller of claim 2, wherein the first duration of the first soft start is the same as the second duration of the second soft start.

4. The radiator fan soft-start controller of claim 2, wherein the first duration of the first soft start is different from the second duration of the second soft start.

5. The radiator fan soft-start controller of claim 2, wherein the first duration of the first soft start is less than the second duration of the second soft start.

6. The radiator fan soft-start controller of claim 1, wherein the first power level of the first soft start is equal to half of the second power level of the second soft start.

7. The radiator fan soft-start controller of claim 1, wherein the second power level of the second soft start corresponds to an operating voltage of the vehicle.

8. The radiator fan soft-start controller of claim 1, wherein the pulse width modulator comprises:

a pulse width modulator power switch that is controllably coupled to the processor system and that generates a series of power pulses defined by the processor system, wherein an output of the pulse width modulator power switch is coupled to the input of the radiator fan motor, wherein each subsequent power pulse in the series of power pulses has an increasing duration greater than the previous power pulse, wherein a first one of the series of power pulses has a smallest duration of the series of power pulses and is generated in response to receiving the first fan speed signal, and wherein a last one of the series of power pulses has a largest duration of the series of power pulses and is generated proximate to a conclusion of the first soft start.

9. The radiator fan soft-start controller of claim 8, wherein the pulse width modulator power switch provides the series of power pulses to the radiator fan motor after the conclusion of the first soft start, and wherein the series of power pulses corresponds to the first power level provided to the radiator fan motor.

10. The radiator fan soft-start controller of claim 8, wherein the pulse width modulation power switch is turned to an on state to begin each one of the series of power pulses, and wherein the pulse width modulator power switch is turned to an off state to end each one of the series of power pulses.

11. The radiator fan soft-start controller of claim 8, wherein the series of power pulses during the first soft start is a first series of power pulses, wherein the pulse width modulator power switch generates a second series of power pulses after the conclusion of the first soft start, wherein the second series of pulses have a same predefined duration, and wherein each one of the second series of power pulses are separated from each other by the same predefined duration.

12. The radiator fan soft-start controller of claim 8, wherein the processor system detects an end to the received first fan speed signal, wherein the processor system provides a soft shutdown of the radiator fan motor in response to detecting the end of the first fan speed signal, wherein the soft shutdown is defined by a decreasing power ramp that starts at the first power level and ends at the zero-power level, and wherein the radiator fan motor receives no power at a conclusion of the soft shutdown.

13. The radiator fan soft-start controller of claim 12, wherein during the soft shutdown, the processor system generates a third series of power pulses of decreasing duration in response to detecting the end of the first fan speed signal, wherein a first one of the third series of power pulses has a largest duration of the third series of power pulses and is generated in response to detecting the end of the first fan speed signal, and wherein a last one of the third series of power pulses has a smallest duration of the third series of power pulses and is generated proximate to the conclusion of the soft shutdown.

14. The radiator fan soft-start controller of claim 1, wherein the pulse width modulator comprises:

a pulse width modulator power switch that is controllably coupled to the processor system and that generates a series of power pulses defined by the processor system, wherein an output of the pulse width modulator power switch is coupled to the input of the radiator fan motor, wherein each subsequent power pulse in the series of power pulses has an increasing duration greater than the previous power pulse, wherein a first one of the series of power pulses has a smallest duration of the series of power pulses and is generated in response to receiving the second fan speed signal, and wherein a last one of the series of power pulses has a largest duration of the series of power pulses and is generated proximate to a conclusion of the second soft start.

15. The radiator fan soft-start controller of claim 14, wherein the pulse width modulation power switch is turned to an on state to begin each one of the series of power pulses, and wherein the pulse width modulator power switch is turned to an off state to end each one of the series of power pulses.

16. The radiator fan soft-start controller of claim 14, wherein the pulse width modulator power switch provides the second power level to the radiator fan motor after the conclusion of the second soft start by maintaining the pulse width modulator power switch in an on state to provide the second power level.

17. The radiator fan soft-start controller of claim 16, wherein the processor system detects an end to the received second fan speed signal, wherein the processor system provides a soft shutdown of the radiator fan motor in response to detecting the end of the second fan speed signal, wherein the soft shutdown is defined by a decreasing power ramp that starts at the second power level and ends at the zero-power level, and wherein the radiator fan motor receives no power at a conclusion of the soft shutdown.

18. The radiator fan soft-start controller of claim 17, wherein the pulse width modulator power switch generates a third series of power pulses of decreasing duration in response to detecting the end of the second fan speed signal, wherein a first one of the third series of power pulses has a largest duration of the third series of power pulses and is generated in response to detecting the end of the second fan speed signal, and wherein a last one of the third series of power pulses has a smallest duration of the third series of power pulses and is generated proximate to the conclusion of the soft shutdown.

19. The radiator fan soft-start controller of claim 1, further comprising:

a filter coupled between an output of the pulse width modulator and the input of the radiator fan motor, wherein the filter conditions the first power level and the second power level.

* * * * *